United States Patent [19]

Brookman et al.

[11] 4,194,359

[45] Mar. 25, 1980

[54] MEANS FOR IMPROVING THE PERFORMANCE OF BURNER SHROUD DIFFUSERS

[75] Inventors: Edward T. Brookman, East Hampton; Robert P. Lohmann, South Windsor; Stanley J. Markowski, East Hartford, all of Conn.

[73] Assignee: United Technologies Corporation, Hartford, Conn.

[21] Appl. No.: 859,881

[22] Filed: Dec. 12, 1977

[51] Int. Cl.[2] ..... F02C 3/14

[52] U.S. Cl. ..... 60/39.36; 60/751

[58] Field of Search ..... 60/39.36, 39.69, 39.65; 415/DIG. 1

[56] References Cited

U.S. PATENT DOCUMENTS

| | | | |
|---|---|---|---|
| 3,039,736 | 6/1962 | Pon | 415/DIG. 1 |
| 3,811,277 | 5/1974 | Markowski | 60/39.69 |
| 3,934,409 | 1/1976 | Quillevere et al. | 60/39.71 |

*Primary Examiner*—Robert E. Garrett

*Attorney, Agent, or Firm*—Charles A. Warren

[57] ABSTRACT

The performance of the diffuser action of burner shrouds is improved by establishing a substantially uniform velocity profile across the shroud passage by introducing a strong secondary flow in the form of vortices that lead to a better velocity profile and much improved diffuser action in the shroud passages.

3 Claims, 3 Drawing Figures

MEANS FOR IMPROVING THE PERFORMANCE OF BURNER SHROUD DIFFUSERS

BACKGROUND OF THE INVENTION

The pressure recovery in the diffusing burner shrouds is restricted because the flow entering these shrouds comes from regions adjacent to the compressor walls, composed to a significant extent of the boundary layers. The result is a badly skewed radial velocity profile with a resulting pressure recovery substantially less than would be obtained with a more uniform velocity profile.

SUMMARY OF THE INVENTION

The principal feature of this invention is a device by which to correct this skewed profile to a more uniform velocity profile thereby to permit more efficient diffusion within these diffusing shroud passages. Another feature is the creation of a controlled turbulence in the form of vortices by which to produce the desired substantially uniform radial velocity profile.

According to this invention, the shroud has a series or cascade of airfoils spanning the shroud passage, preferably positioned to straighten the flow that has a residual swirl from the compressor, these vanes interacting with the radial velocity gradient to establish a strong secondary flow in the vane passages sufficient to create vortices between and downstream of the spaces between adjacent vanes.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Burner constructions of the general type to which this invention is applicable are shown in Highberg U.S. Pat. 2,801,520 although it has greater utility in later, higher performance engines where the higher pressure rise in the diffusers in the burner shrouds is more necessary to provide an adequate pressure differential between the pressure within the combustion space, and the air space surrounding the combustion space and divided therefrom by the burner walls. This pressure differential must be high enough to assure adequate inflow of air into the combustion space for burner wall cooling, for complete combustion with a minimum of pollutant generation during combustion, and for further cooling of the gas entering the turbine and for the cooling air used in cooling the turbine vanes and/or their supporting ends.

Figure 1:
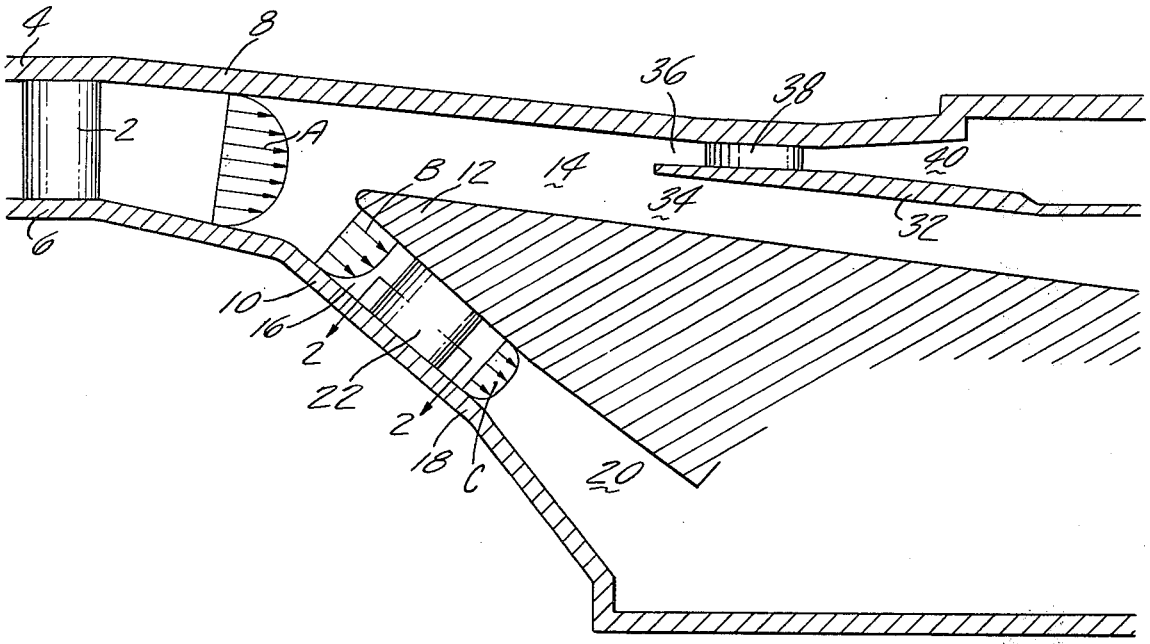
FIG. 1 is a longitudinal sectional view through the inlet to an engine burner.
Figure 2:
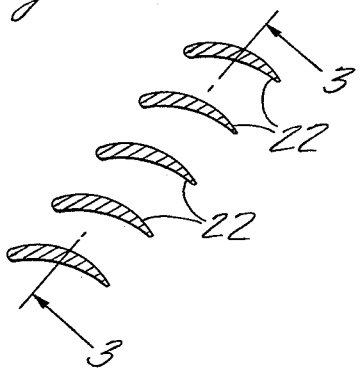
FIG. 2 is a section along line 2—2 of FIG. 1.

In the arrangement of FIG. 1, the compressor is represented by the exit guide vanes 2 extending between the inner and outer walls 4 and 6 of the compressor. Air from the compressor discharges into the diffuser section having inner walls 8 and 10 forming extensions of walls 4 and 6 but diverging from one another to provide the desired diffuser action. Between the walls 8 and 10 is a splitter wedge 12 downstream of which is the burner can or burner unit not shown. This splitter wedge defines two passages 14 and 16, the inner passage 14 receiving the main combustion air to the burner and the outer passage 16 receiving the shroud air that is used for cooling and is mixed with the gases in the burner for complete combustion. It is desirable that this air be effectively diffused for a high pressure recovery.

It will be apparent that the outer passage 16 has relatively parallel walls to a point 18 a distance downstream of the tip of the wedge and the walls then diverge significantly in a downstream direction to form a diffuser area 20. The purpose of the present invention is to create a substantially uniform velocity profile upstream of the point 18 thereby to improve the diffuser action in this divergent area or passage 20 downstream of this point. To accomplish this the passage 16 has a series or cascade of vanes 22 so positioned as to remove the swirl in the air discharging from the compressor and, in straightening the flow, to create turbulence or vortices that will establish a relatively uniform velocity profile.

FIG. 1 shows the velocity profile as the air leaves the compressor in diagram A. As this air, having a swirl about the engine axis, reaches the splitter, the outer portion of the air enters the passage 16 with the velocity profile as in diagram B. Thus, there is a seriously skewed velocity profile with much higher velocity air along the inner portion of the passage.

Figure 3:
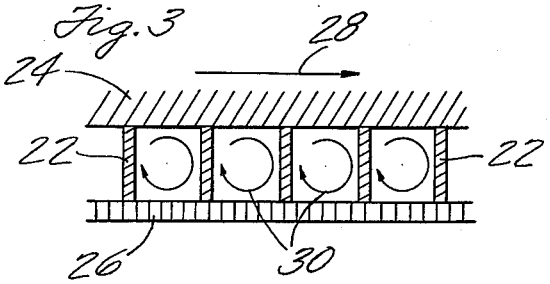
FIG. 3 is a section at right angles to FIG. 2 showing the vortices formed.

As the air passes between the vanes 22 the high pressure on the concave side of the vane and the low pressure on the convex side of the vane combined with the pressure differential from the swirl result in a vortex between adjacent vanes as shown in FIG. 3 where the inner wall of the passage 16 is represented by the wall 24 and the outer wall is represented by the wall 26, that is the wedge and the outer wall of the diffuser, respectively.

The direction of the swirl in this air as it approaches the vanes in the cascade is represented by the arrow 28, and the effect of this swirl combined with the pressure differences in each passage produce vortices represented by the arrows 30. These vortices are a secondary flow that results in the relatively uniform velocity profile shown in the diagram C superimposed on FIG. 1. This more nearly uniform velocity profile is a more desirable inlet condition for effective diffuser action in the passage 20 downstream of the cascade or row of vanes.

The same action may be obtained adjacent the inner wall 8 in the passage between this wall and the splitter wedge. This passage has a secondary splitter or inner shroud 32 closely spaced from the inner wall 8 and having its leading edge spaced downstream from the tip of the main splitter. This shroud 32 forms a main passage 34 for the combustion air going directly to the burner and a secondary parallel passage or shroud air passage 36, between the shroud 32 and the inner wall 4 for cooling air passing externally of the combustion chamber.

Between this shroud 32 and the inner wall 8 is a row of straightening vanes 38 similar to the vanes 22 and producing the secondary flow or vortices as described above. This secondary flow produces a substantially uniform velocity profile across passage 36 to improve the diffuser action in the portion of this passage where the wall 8 diverges from the shroud 32 downstream of the cascade to form a diffuser area 40 by which to increase the pressure in the air in this passage. The higher pressure in these diffusers improves the flow of cooling, combustion and dilution air from these passages into the combustion chamber and also improves the flow of cooling air through the turbine vanes and around the vane ends.

The improved and nearly uniform velocity profile is obtained by the mechanism above described with no significant pressure losses in the system and avoids the use of or need for complex boundary layer removal systems with associated cycle performance penalties.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A burner shroud construction including:

inner and outer walls defining a passage for air flow from the compressor, the air flow adjacent the walls being slower than the mid-stream flow;

a splitter element cooperating with one of said walls and spaced therefrom to divide the air into combustion air on one side of the splitter and shroud air which receives the flow adjacent said one wall such that on the other side between the splitter and said one of said walls the air enters with a skewed velocity profile, said element and said cooperating wall defining therebetween a shroud passage;

a row of turning vanes extending across said shroud passage to change the flow in said passage and produce a pressure differential on opposite sides of each vane thereby producing vortices between adjacent vanes; and said shroud passage, downstream of the vanes having diverging walls to form a diffuser, the vortices induced by the vanes being a secondary transverse flow thereby improving and making more uniform the velocity profile across the shroud passage at the upstream end of the diffuser to increase the pressure recovery in the diffuser.

2. A burner shroud construction as in claim 1 in which the air from the compressor has a swirl and the vanes are positioned to straighten the flow.

3. A burner shroud construction including:

a diffusing passage having inner and outer walls receiving discharge air from a compressor in which the air has a swirl and in which the air velocity increases from either wall to a maximum near the middle of the passage;

a splitter adjacent to one of said walls and cooperating therewith to define a shroud passage between said one of said walls and the splitter for shroud air, and a passage on the other side of the splitter for combustion air, the shroud air, being picked from adjacent said one of said walls, having a skewed velocity as it enters the shroud passage;

a row of vanes extending between said one of said walls and the splitter, in the path of the shroud air, and positioned to straighten the flow of the shroud air; and a diffusing area formed by said one of said walls and the splitter diverging downstream from a point close to said vanes, said vanes causing a secondary flow or vortices in the air passing therethrough to establish a substantially uniform velocity profile across said shroud passage downstream of the vanes at the entry to the diffuser to improve pressure recovery in the diffuser area.

* * * * *